US009238856B2

(12) United States Patent
Sandström et al.

(10) Patent No.: US 9,238,856 B2
(45) Date of Patent: Jan. 19, 2016

(54) LEAD FREE FREE-CUTTING STEEL

(71) Applicant: Sandvik Intellectual Property AB, Sandviken (SE)

(72) Inventors: Mattias Sandström, Skellefteå (SE); Ylva Trogen, Sandviken (SE); Lars Karlsson, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 72 days.

(21) Appl. No.: 13/934,664

(22) Filed: Jul. 3, 2013

(65) Prior Publication Data

US 2013/0294961 A1 Nov. 7, 2013

Related U.S. Application Data

(63) Continuation of application No. 12/449,023, filed as application No. PCT/SE2008/050074 on Jan. 24, 2008, now Pat. No. 8,540,934.

(30) Foreign Application Priority Data

Jan. 26, 2007 (SE) ..... 0700192

(51) Int. Cl.

| | |
|---|---|
| ***C22C 38/02*** | (2006.01) |
| ***C22C 38/04*** | (2006.01) |
| ***C22C 38/16*** | (2006.01) |
| ***C22C 38/60*** | (2006.01) |
| ***C22C 38/42*** | (2006.01) |
| ***C22C 38/20*** | (2006.01) |
| ***C22C 38/54*** | (2006.01) |
| ***C22C 38/00*** | (2006.01) |

(52) U.S. Cl.

CPC ..... *C22C 38/54* (2013.01); *C22C 38/002* (2013.01); *C22C 38/02* (2013.01); *C22C 38/04* (2013.01); *C22C 38/42* (2013.01); *C22C 38/60* (2013.01)

(58) Field of Classification Search

None

See application file for complete search history.

(56) References Cited

U.S. PATENT DOCUMENTS

| | | | |
|---|---|---|---|
| 2,789,069 | A | 4/1957 | Nachtman |
| 3,567,435 | A | 3/1971 | Monnot |
| 5,648,044 | A | 7/1997 | Hoshino et al. |
| 6,099,797 | A | 8/2000 | Bhagwat et al. |

(Continued)

FOREIGN PATENT DOCUMENTS

| | | |
|---|---|---|
| CN | 1293716 A | 5/2001 |
| EP | 0 668 365 | 11/1997 |

(Continued)

OTHER PUBLICATIONS

Japanese Office Action (Application No. 097102321) dated Mar. 12, 2013.

(Continued)

*Primary Examiner* — Deborah Yee

(74) *Attorney, Agent, or Firm* — Morgan, Lewis & Bockius LLP

(57) ABSTRACT

A lead free free-cutting steel is described having the following composition in percent by weight: C 0.85-1.2 Si 0.1-0.6 Mn 0.4-1.2 P max 0.05 S 0.04-0.3 Cr max 2 Ni max 1 Mo max 0.5 Cu max 2 Al max 0.1 B max 0.008 Bi+Se+Te max 0.005 Ti+Nb+Zr+V max 0.2 balance Fe and normally occurring impurities. The steel is mainly intended for small/thin dimensions and/or low cutting speeds during manufacture of a product formed of the steel.

10 Claims, 5 Drawing Sheets

(56) References Cited

U.S. PATENT DOCUMENTS

| | | | |
|---|---|---|---|
| 6,475,305 | B1 | 11/2002 | Watari et al. |
| 2003/0066577 | A1 | 4/2003 | Ishida et al. |
| 2003/0113223 | A1 | 6/2003 | Kano et al. |
| 2006/0289402 | A1 | 12/2006 | Kimura et al. |

FOREIGN PATENT DOCUMENTS

| | | | |
|---|---|---|---|
| EP | 1 188 846 | | 3/2002 |
| EP | 1 270 757 | | 7/2007 |
| EP | 1 529 852 | | 12/2008 |
| EP | 2 083 094 | | 7/2009 |
| EP | 2 090 671 | | 8/2009 |
| JP | S61-153264 | A | 7/1986 |
| JP | H07-188847 | A | 7/1995 |
| JP | 9-176786 | | 7/1997 |
| JP | 9-176787 | | 7/1997 |
| JP | H09-176787 | A | 7/1997 |
| JP | 11-199968 | | 7/1999 |
| JP | 11-302778 | | 11/1999 |
| JP | 2000-119805 | | 4/2000 |
| JP | 2000-119805 | A | 4/2000 |

OTHER PUBLICATIONS

Taiwanese Preliminary Examination Report and English translation issued Mar. 12, 2013, in Taiwanese Patent Application No. 097102321.

Machine-English translation of Japanese patent No. 07-188847, Takashi et al., Jul. 25, 1995.

Notification of the First Office Action against CN200880003225.5, dated Jun. 25, 2010.

Notification of the Second Office Action against CN200880003225.5, dated Feb. 18, 2011.

Notification of the Third Office Action against CN200880003225.5, dated Jun. 16, 2011.

Communication Pursuant to Article 94(3) EPC against EP 08705346.8, dated Jun. 16, 2010.

Communication Pursuant to Article 94(3) EPC against EP 08705346.8, dated Jun. 22, 2011.

Machine-English Translation of Japanese patent 09-176787, Uno Mitsuo et al., Jul. 8, 1997.

English abstract of Japanese patent 410060595, Atsumi, Takuya et al., Mar. 3, 1998.

English abstract of Japanese patent 61153264, Nishikiori, K., Jul. 11, 1986.

English abstract of Japanese patent 360089520, Muraishi, Katsuyoshi, May 20, 1985.

LEAD FREE FREE-CUTTING STEEL

This application is a continuation of U.S. patent application Ser. No. 12/449,023, filed on Jan. 22, 2010, now U.S. Pat. No. 8,540,934 which is a National Stage entry of International Application No. PCT/SE2008/050074, filed on Jan. 24, 2008, which claims priority to Swedish Application No. 0700192-8, filed on Jan. 26, 2007, the entire disclosure of each of which is incorporated herein for all purposes.

The present invention relates to a lead free steel and to the use thereof. More specifically, it relates to a free-cutting steel which is free of lead and has good hardenability, machinability and wear resistance.

BACKGROUND

There is a plurality of different applications for free-cutting steels. Examples of applications are in measuring probes and instruments, as automotive parts (such as fuel injection systems and precision valves for ABS brakes) and as watch parts, which are all examples of applications manufactured from and/or using wires. The applications mentioned all utilize wire or rod in small dimensions. This may also lead to a necessity of using low cutting speeds during manufacturing of a component due to limitations in the machining equipment used. In this context, small dimensions are considered to be wire diameters less than 15 mm. The applications mentioned above generally require the properties machinability, hardenability and wear resistance to be concurrently optimised. In some cases, also the corrosion properties, i.e. tendency to formation of rust, during storage and/or manufacturing of a component of the steel might be of importance.

Free-cutting steels commonly used today often contain lead, which is an effective element for providing the desired machinability. However, lead is a hazardous element for the environment and therefore the development within environmental legislation indicates that lead may become prohibited or limited as alloying material in steel. In this context, environmentally friendly is considered to mean non hazardous for nature or persons in close proximity with the material, during manufacturing, especially hot working, machining of components, use and recycling.

One example of a lead containing free-cutting steel is Sandvik 20AP, which has a nominal composition of 1% by weight of C, 0.2% by weight of Si, 0.4% by weight of Mn, 0.05% by weight of 5 and 0.2% by weight of Pb. This steel has very good machinability, wear resistance and hardenability as well as excellent dimensional stability after heat treatment. Due to these properties, it is highly suitable for long narrow components, such as shafts in measuring instruments, and precision valves, especially in the automotive industry. It can also be used in other applications such as watch components, measuring probes and precision tools. However, since this material contains lead it is not considered as environmentally friendly.

Examples of lead free free-cutting steels can be found in US 2003/0113223 A1, EP 1270757 A and U.S. Pat. No. 5,648,044 A, all which are for machine structural use. These steels do, however, not provide properties that are satisfactory for small dimensions, and do therefore not constitute appropriate compositions.

Consequently, it is an object of the invention to provide an alternative steel, which may be used as wire, especially in small dimensions, and which is not detrimental to the environment.

SUMMARY

The object is achieved by a steel in accordance with claim 1. The steel is free from lead and is consequently much less hazardous for the environment. Furthermore, it has a high hardenability, good machinability and high wear resistance. It also has similar or slightly better corrosion properties compared to prior art, such as the lead containing steel Sandvik 20AP.

The lead free free-cutting steel according to the invention is highly suitable for use in applications such as measuring probes and instruments, automotive parts, such as fuel injection systems and precision valves for ABS brakes. It is also highly suitable for use in watches.

Even though the steel is developed for use in small dimensions, primarily such as in the applications mentioned above, it may also be used in other applications demanding hardenability and machinability, and to which free-cutting steels are considered as being an appropriate material selection.

DETAILED DESCRIPTION

Figure 1A:
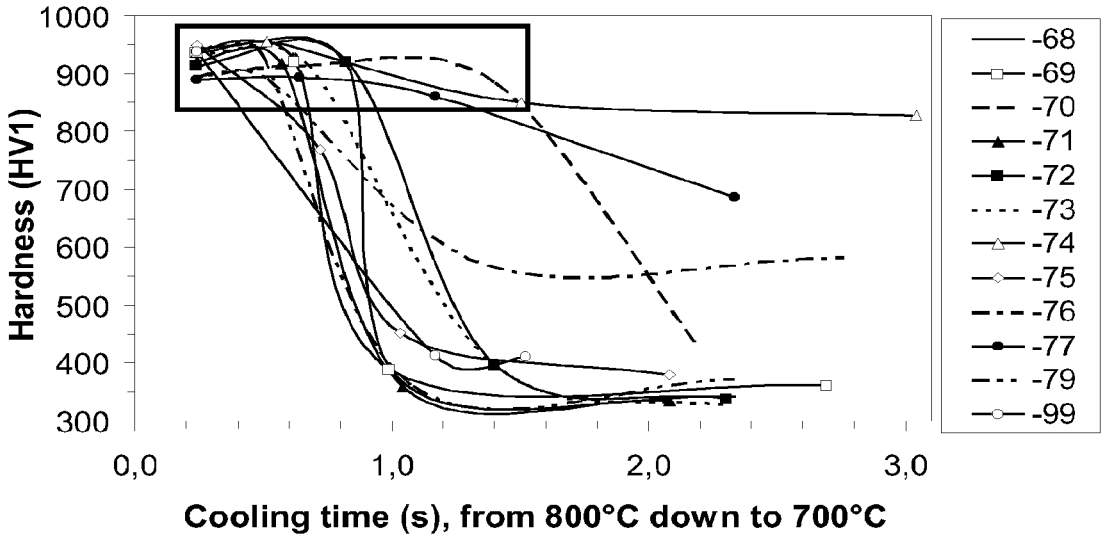
FIG. 1*a* shows the Vickers hardness (HV1) of some tested compositions as a function of cooling rate for some trial heats.

The content and the effect of the different elements are described below, wherein all figures relating to the content are in percent by weight (wt-%).

C 0.85-1.2 wt-%

Carbon will improve the hardness of the steel by increasing the hardness of martensite and increasing the carbide fraction. Too high amount of carbon may, however, deteriorate the machinability. Therefore, the upper limit of carbon in this steel should be 1.2 wt-% in order to avoid a decrease of the machinability. In order to achieve appropriate hardness and wear resistance of a manufactured component of the steel to be used in the intended application, the lower limit of carbon should be 0.85 wt-%.

Low carbon content is beneficial for the machinability, but has a detrimental effect on other properties. These detrimental effects can be neutralized by increased amounts of alternative elements. Reduced carbon content may decrease the hardenability, but can be compensated by an increase of elements, such as manganese, chromium, copper and nickel, that improve the hardenability, i.e. delay the transformation to pearlite/bainite. Reduced carbon content also leads to a decreased fraction of carbides, which can be compensated by an increase in carbide forming elements, mainly chromium. However, a raised chromium content have to be balanced against the carbon content and the hardening temperature, in order to obtain an optimal combination of hardness and wear resistance of the material. According to a preferred embodiment, the carbon content should be 0.9-1.1 wt-%.

Si 0.1-0.6 wt-%

Silicon has a solution hardening effect. Silicon also increases the carbon activity during tempering. Moreover, due to the high affinity to oxygen, silicon is often used to deoxidize steel during manufacture, in order to improve the purity of the material. These effects are not available at a silicon content less than 0.1 wt-%. At high silicon contents the hot forming processability deteriorates. Therefore, the silicon content should not exceed 0.6 wt-% silicon, preferably maximally 0.4 wt-%. According to a preferred embodiment, the silicon content is 0.15-0.3 wt-%, more preferably 0.2-0.3 wt-%.

Mn 0.4-1.2 wt-%

Manganese influences the morphology of the sulphides and leads to formation of manganese sulphides, which increase the machinability of the steel. Manganese also leads to a tendency of increased work hardening and higher hardenability. Large amounts of manganese in a free-cutting steel can, however, reduce the corrosion resistance. Manganese contents less than 0.4 wt-% lead to an insufficient amount of sulphides, while an excess amount of manganese, more than 1.2 wt-%, result in an increased tendency of work hardening, which in turn lead to decreased machinability. Preferably, the Mn content is 0.5-1.1 wt-%, more preferably 0.5-0.7 wt-%.

P max 0.05 wt-%

Phosphorous is generally harmful for the steel due to risk of embrittlement. A phosphorous content over 0.2 wt-% is therefore unfavourable. In this case, the amount of phosphorous is set to be maximally 0.05 wt-%, in order to make recirculation of produced scrap during machining possible. Preferably, the steel should have a phosphorus content of maximally 0.03 wt-%.

S 0.04-0.3 wt-%

Sulphur increases the machinability of the steel due to formation of sulphides, e.g. manganese sulphides. These sulphides readily undergo plastic deformation during rolling, forging or cold drawing, and tool wear during machining is drastically reduced. The sulphur content needed to achieve improvement in machinability is 0.04 wt-% or more, preferably at least 0.05 wt-%, more preferably at least 0.08 wt-%. However, high sulphur content could lead to problems during hot forming. The corrosion properties and surface quality can also be negatively affected. Results of previous investigations have indicated that the maximum content of sulphur is around 0.3 wt-%. The machinability of a steel with a sulphur content above this limit is not as positively affected of an increased sulphur content compared with a material with sulphur content below 0.3 wt-%. Therefore, the sulphur content should be maximally 0.3 wt-%, preferably maximally 0.25 wt-%, more preferably maximally 0.15 wt-%.

Cr max 2 wt-%

Chromium in high amounts will lead to formation of stainless steel. In lower amounts it will improve the corrosion properties. Chromium is also an element that improves the hardenability, and will form chromium sulphide if the manganese content is too low. In the present invention the chromium content should be a maximally 2 wt-% to avoid any negative effects on the properties of the material. Higher chromium content results in a sharp increase of the carbide fraction and a decrease of the carbon content in the matrix, which causes lower martensite hardness. Changes in the cementite carbide structure are also expected at higher chromium contents. Preferably, the chromium content should be 0.1-0.8 wt-%, more preferably 0.1-0.5 wt-%.

Ni max 1 wt-%

Nickel added in small amounts has no substantial effect on machinability, corrosion or hardenability. In higher amounts, nickel stabilizes the austenitic phase and increases the amount of retained austenite after hardening, which reduces the hardness, although the hardenability and toughness may be improved. Due to high costs for nickel alloys, the nickel content should be below 1 wt-%, preferably maximally 0.5 wt-%, more preferably maximally 0.4 wt-%.

Mo max 0.5 wt-%

Molybdenum increases the hardenability. However, a high molybdenum content might impair the hot workability of the steel. The upper limit for molybdenum should therefore be 0.5 wt-% in this case. Molybdenum is often present at impurity levels due to the raw material used, i.e. up to approximately 0.1 wt-%.

Cu max 2 wt-%

Copper could give a positive effect on the machinability in regards to tool lifetime, such as at turning. Copper has also been reported to give improved corrosion properties, and in particular it reduces the rate of general corrosion. However, if added in too high contents copper could lower the hot ductility of the material and deteriorate the ability of creating as small chips as possible. Copper can therefore be added in an amount of up to 2 wt-%. Preferably, the copper content is 0.02-1.8 wt-%, more preferably 0.3-1.7 wt-%. According to one embodiment, the alloy may contain 0.3-1.0 wt-% Cu.

Al max 0.1 wt-%

Normally aluminium is added to the material as a deoxidizing agent in order to improve the purity of the steel. However, large amounts of aluminium will have a negative effect on the machinability, which in turn increases tool wear, due to increased amount of hard and brittle aluminium oxides in the steel. In the present invention the aluminium content should therefore be as low as possible, <0.1 wt-%, to avoid reduced machinability. Because of the negative effect on the tool life caused by aluminium oxides in a steel, silicon should preferably be used as deoxidizing agent during manufacture of the steel according to the present invention.

B max 0.008 wt-%

Boron enhances the hardenability of the steel and also in small amounts improves the hot workability. However, formation of boron nitrides is sometimes considered to cause increased tool wear due to the relatively high hardness of the formed inclusions. Boron in excessive amounts is also generally considered to cause poor hot ductility of the material. Consequently the boron content should be maximally 0.008 wt-% in the steel, preferably maximally 0.005 wt-%. According to an embodiment, the steel is free of boron additions.

Bi+Se+Te max 0.005 wt-%

Bismuth improves the machinability. However, alloying with bismuth is fairly expensive. Selenium and tellurium are also machinability-improving elements. However, the amount of both selenium and tellurium should be as low as possible, mainly due to cost and environmental reasons. Bismuth, selenium and tellurium may be added up to maximally 0.005 wt-% in total. According to a preferred embodiment, the steel does not contain any additions of bismuth, selenium or tellurium.

Ti+Nb+Zr+V max 0.2 wt-%

The titanium content should be as low as possible to avoid formation of inclusions of titanium carbonitrides. These inclusions are very hard and will lead to increased tool wear. Hence, the titanium content should be as low as possible.

Normally niobium is useful to prevent coarsening of the crystal grains in the steel at high temperature, but endogenously formed niobium nitrides will have a detrimental effect on the machinability. Consequently the niobium content should be kept as low as possible.

In materials not specifically intended for applications requiring machining, zirconium is sometimes added to prevent grain growth during processing and to decrease brittleness of the steel. However, zirconium may form carbides and/or nitrides, which increase the tool wear. Therefore the zirconium content should be as low as possible.

Vanadium combines with nitrogen and carbon to form carbonitrides, which prevents grain growth in the steel. However vanadium carbonitrides have the same effect as titanium carbonitrides on the tool wear, which means that the vanadium content should be as low as possible.

Consequently, to avoid negative effects on the machinability, the sum of the titanium, niobium, zirconium and vanadium additions should be maximally 0.2 wt-% According to an embodiment, the steel is free from additions of titanium, niobium, zirconium and vanadium. It should, however, be noted that these elements may be present as impurities due to the choice of raw material.

Impurities

The steel may also contain normally occurring impurities due to the raw material used and/or the manufacturing process selected. The content of these impurities should, however, be controlled such that the properties of the produced steel are substantially unaffected by the presence of these impurities. One example of such an impurity is nitrogen which is suitably kept below 0.08 wt-%. Other examples are phosphorous and aluminium, which have been described above, and the amounts thereof should be carefully monitored.

The steel according to the invention can be produced by conventional melting processes, such as high frequency furnace melting or AOD. The steel may suitably be hardened at soaking temperatures of 750-950° C.

According to a preferred embodiment the steel has an approximate composition (in percent by weight) of:

C 1
Si 0.2
Mn 0.5
P max 0.02
S 0.1
Cr 0.2
Ni max 0.4
Cu 1.5
balance Fe and normally occurring impurities.

According to another preferred embodiment, the steel has an approximate composition (in percent by weight) of:

C 1
Si 0.3
Mn 1
P max 0.02
S 0.1
Cr 0.2
Ni 0.05
Cu 0.03
balance Fe and normally occurring impurities.

According to a third preferred embodiment, the steel has an approximate composition (in percent by weight) of:

C 1
Si 0.2
Mn 0.5
P max 0.02
S 0.1
Cr 0.5
Ni 0.4
Cu 0.4
balance Fe and normally occurring impurities.

According to a fourth preferred embodiment, the steel has an approximate composition (in percent by weight) of:

C 0.9
Si 0.2
Mn 0.5
P max 0.02
S 0.1
Cr 1.5
Ni max 0.1
Cu 0.4
balance Fe and normally occurring impurities.

The steel according to the present invention typically has a hardness, when hardened at approximately 800° C., of at least 850 HV1 as quenched, and at least 600 HV1 after 30 minutes of tempering at 300° C. It also has a machinability, which in terms of cutting time before the insert wear criteria is reached, is at least as good as the machinability of a corresponding lead alloyed steel. When using indexable hard metal inserts and a cutting speed of approximately 15 m/min, a cutting time of at least 10 hours can be reached.

Example 1

Compositions

Twelve different trial heats of the alloy according to the invention were produced by high-frequency furnace melting with subsequent casting into ingots of 270 kg. To prevent cracking, the ingots were allowed to cool slowly to room temperature from about 1550° C. in an insulated environment for a week before reheating and forging into round bars Ø45 mm. Prior to all testing the materials were soft annealed at about 750° C. for approximately 4 hours followed by controlled cooling at a rate of approximately 10° C./h.

The chemical compositions for the trial heats and for the lead containing reference material (REF1) are given in Table 1 wherein all figures are given in percent by weight. The reference material was produced by means of large scale melting, secondary refining and continuous casting.

TABLE 1

| Heat | C | Si | Mn | S | Cr | Ni | Cu | Other |
|---|---|---|---|---|---|---|---|---|
| −68 | 0.97 | 0.24 | 0.50 | 0.046 | 0.17 | 0.07 | 0.025 | |
| −69 | 0.93 | 0.22 | 0.54 | 0.091 | 0.17 | 0.06 | 0.026 | |
| −70 | 0.96 | 0.27 | 1.10 | 0.097 | 0.18 | 0.06 | 0.026 | |
| −71 | 1.00 | 0.22 | 0.89 | 0.24 | 0.16 | 0.06 | 0.025 | |
| −72 | 1.01 | 0.23 | 0.57 | 0.12 | 0.17 | 0.06 | 0.026 | B 41 ppm |
| −73 | 0.99 | 0.21 | 0.52 | 0.094 | 0.17 | 0.37 | 0.026 | |
| −74 | 1.01 | 0.23 | 0.53 | 0.11 | 0.52 | 0.35 | 0.36 | |
| −75 | 1.01 | 0.22 | 0.52 | 0.11 | 0.17 | 0.36 | 0.51 | |
| −76 | 1.01 | 0.20 | 0.51 | 0.088 | 0.17 | 0.06 | 1.65 | |
| −77 | 0.91 | 0.22 | 0.53 | 0.091 | 0.17 | 0.33 | 1.50 | |
| −79 | 1.02 | 0.20 | 0.48 | 0.057 | 0.18 | 0.06 | 0.028 | Bi 0.047% |
| −99 | 1.00 | 0.26 | 0.65 | 0.067 | 0.18 | 0.07 | 0.023 | Ca 33 ppm |

All compositions of the trial heats contained max 0.03% P, max 0.02% N, max 0.05% Mo, max 0.05% Al and max 0.03% V, which are considered to be impurities in the trial heats. Mo can, however, in some cases be added to the material in order to increase the corrosion resistance.

Example 2

Hardenability

Test specimens of the heats −68 to −77, −79 and −99 of Example 1, in the form of hollow specimens with outer diameter 4.9 mm, inner diameter 4.1 mm and length 12.5 mm, were hardened by heating from room temperature to 800° C. at a rate of 25° C./s. The test specimens were kept at 800° C. for 5 minutes. Thereafter, cooling of the test specimens with controlled cooling rates was achieved by flushing the specimens with helium. The hardenability of the heats was tested by using a Quench-dilatometer in order to accomplish the controlled cooling rate. A low cooling rate may lead to undesirable phase transformations of the austenite phase, such as to bainite or perlite, instead of martensite, which lead to a decrease in the hardness of the material.

Figure 1B:
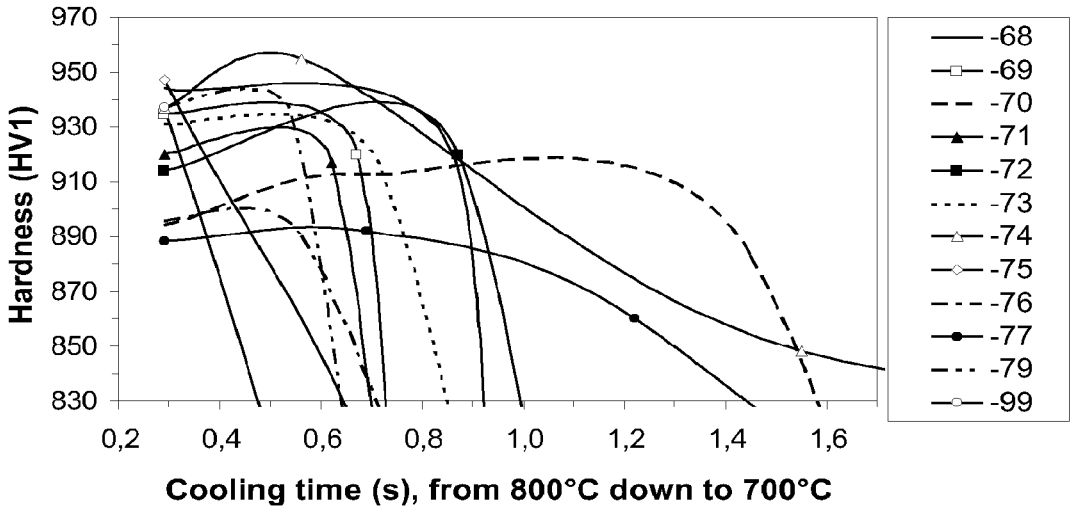
FIG. 1*b* shows a magnification of a part of FIG. 1*a*. The marked section in FIG. 1*a* represents the area, which has been magnified.

After heat treatment the specimens were investigated with respect to Vickers hardness (HV1) and microstructure. In FIG. 1*a* and FIG. 1*b* the hardness of the tested materials after hardening are shown as a function of the time (number of seconds) it took to cool the material from 800° C. to 700° C. The cooling rates varied from approximately 30° C./sec to 400° C./sec. The test results showed in FIG. 1*a* and FIG. 1*b* are also listed in Table 2.

It can be seen that three materials, heats −70, −74 and −77 have higher hardenability than the other materials, which is shown by a high hardness even after hardening at lower cooling rates. It is well known that a lower cooling rate, while still achieving a satisfactory hardness, indicates that the material can be more easily produced since the quenching speed is less critical. Heat −70 has a high content of manganese (1.1% by weight) whereas heat −74 has relatively high contents of chromium, nickel and copper (0.53% Cr, 0.35% Ni and 0.36% Cu) and heat −77 has a relatively high content of nickel (0.34%) and a high copper content (1.50%). For the other tested materials, differences in hardenability are less noticeable.

TABLE 2

| | 1 | | 2 | | 3 | | 4 | |
|---|---|---|---|---|---|---|---|---|
| Heat | Hardness (HV1) | Time (s) | Hardness (HV1) | Time (s) | Hardness (HV1) | Time (s) | Hardness (HV1) | Time (s) |
| −68 | 944 | 0.24 | 914 | 0.82 | 384 | 1.04 | 341 | 2.33 |
| −69 | 935 | 0.24 | 920 | 0.62 | 384 | 0.99 | 362 | 2.69 |
| −70 | 894 | 0.24 | 913 | 0.66 | 871 | 1.4 | 423 | 2.2 |
| −71 | 920 | 0.24 | 917 | 0.57 | 368 | 1.04 | 334 | 2.08 |
| −72 | 914 | 0.24 | 920 | 0.82 | 399 | 1.4 | 338 | 2.3 |
| −73 | 931 | 0.24 | 914 | 0.67 | 396 | 1.39 | 326 | 2.32 |
| −74 | 937 | 0.24 | 955 | 0.51 | 838 | 1.5 | 828 | 3.04 |
| −75 | 947 | 0.24 | 768 | 0.72 | 425 | 1.03 | 380 | 2.08 |
| −76 | 896 | 0.24 | 890 | 0.51 | 510 | 1.37 | 583 | 2.76 |
| −77 | 888 | 0.24 | 892 | 0.64 | 873 | 1.17 | 685 | 2.33 |
| −79 | 937 | 0.24 | 934 | 0.49 | 370 | 1.08 | 372 | 2.33 |
| −99 | 937 | 0.24 | — | — | 412 | 1.17 | 409 | 1.52 |

Investigations of the microstructures after hardening indicate that the higher hardnesses in heats. −70, −74 and −77, even after lower cooling rates, are due to a higher amount of martensite and not due to the forming of bainite.

The test results indicates that manganese and chromium as well as high amounts of copper have a beneficial effect on hardenability, while smaller amounts of copper (about 0.5% in heat −75), as well as additions of nickel, sulphur, boron, bismuth and calcium, have no or only a limited impact on the hardenability. The increase in hardenability is therefore considered to depend mainly on the elements manganese and chromium, where an increased amount of each improves the hardenability of the material.

Example 3

Hardening Followed by Tempering

In addition to the hardenability test in Example 2, some of the specimens were also used to investigate the material hardness after hardening followed by tempering. Table 3 shows hardness (HV1) for the materials after hardening at approximately 800° C., during about 5 minutes and thereafter tempering for 30 minutes at four different temperatures, 100° C., 200° C., 300° C., and 500° C. The results show that the differences in hardness after hardening and tempering are small. The largest difference in hardness between the different heats can be seen prior to tempering, i.e. after hardening, or after tempering at temperatures below 300° C.

TABLE 3

| | Hardness [HV1] | | | | |
|---|---|---|---|---|---|
| Heat | After hardening | Tempering at 100° C. | Tempering at 200° C. | Tempering at 300° C. | Tempering at 500° C. |
| −68 | 944 ± 14 | 908 ± 4 | not tested | 657 ± 6 | 403 ± 1 |
| −69 | 935 ± 14 | 894 ± 16 | not tested | 658 ± 14 | 359 ± 14 |
| −70 | 894 ± 10 | 940 ± 35 | 689 ± 8 | 673 ± 0 | 398 ± 6 |
| −71 | 920 ± 8 | 920 ± 5 | not tested | 652 ± 12 | 412 ± 4 |
| −72 | 914 ± 4 | 898 ± 1 | not tested | 635 ± 3 | 403 ± 7 |
| −73 | 931 ± 7 | 930 ± 12 | not tested | 650 ± 17 | 402 ± 6 |
| −74 | 937 ± 12 | 904 ± 2 | 771 ± 13 | 657 ± 0 | 395 ± 3 |
| −75 | 947 ± 4 | 934 ± 5 | not tested | 663 ± 3 | 420 ± 7 |
| −76 | 896 ± 8 | 920 ± 5 | not tested | 669 ± 14 | 421 ± 13 |
| −77 | 888 ± 13 | 911 ± 0 | not tested | 659 ± 3 | 422 ± 1 |
| −79 | 937 ± 12 | 951 ± 12 | not tested | 651 ± 3 | 403 ± 4 |
| −99 | 937 ± 13 | 937 ± 18 | 798 ± 6 | 669 ± 7 | not tested |

It is clear that the difference in hardness after hardening and tempering is small among the investigated alloys. A tempering temperature below 300° C. gives the highest difference among the alloys on hardness and on the residual austenite content.

Example 4

Machinability

The machinability of all the compositions given in Example 1 was tested. The test specimens had a diameter of approximately Ø40 mm, and the surface had been turned in advance to minimize the effect of surface defects.

Figure 2:
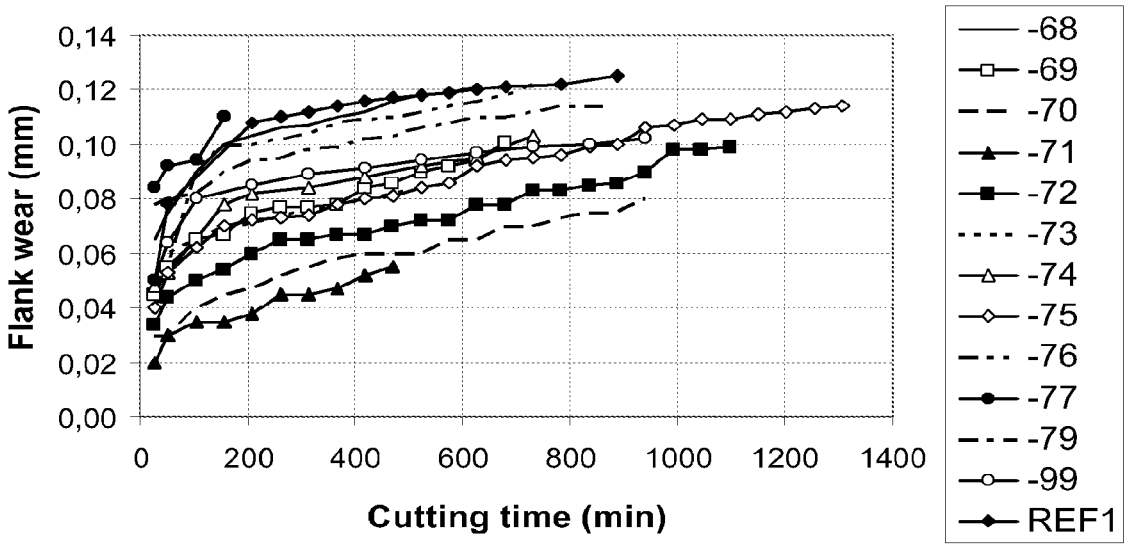
FIG. 2 shows the machinability of some tested compositions as flank wear on a cutting edge as a function of cutting time when using a cutting speed of 15 m/min.
Figure 3:
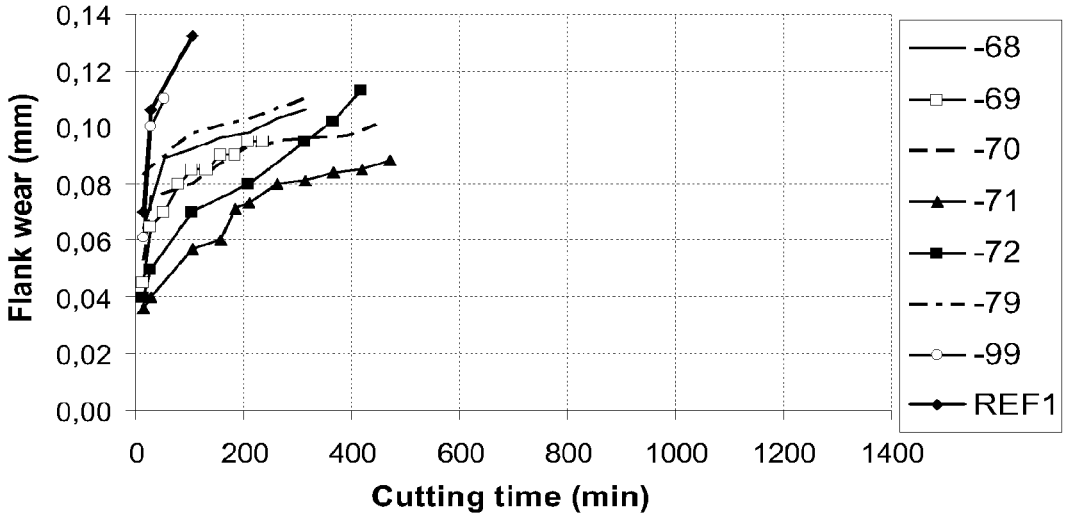
FIG. 3 shows the machinability of some tested compositions as flank wear on a cutting edge as a function of cutting time when using a cutting speed of 30 m/min.

For all machining tests the operation was a longitudinal turning operation with a cutting depth continuously changing between 0.5 mm and 1.5 mm. The cutting speed was 15 m/min. In addition some of the materials were also tested at 30 m/min cutting speed. Cutting feed for all tests was about 0.05 mm/revolution. The machining tests were performed with coated indexable hardmetal inserts of the type Coromant CoroCut XS 3010, grade GC 1025. Evaluation was done by measuring insert wear as a function of cutting time. The results are illustrated in FIG. 2 and FIG. 3 as flank wear on cutting edge as a function of cutting time in minutes.

The results show that all tested material compositions except one (heat −77), give a tool wear rate in the same range as, or slower than, the lead containing reference material REF1.

Higher amounts of sulphur and/or manganese give a better machinability in respect to the tool wear rate, probably due to a higher content of manganese sulphides in the material. Boron seems to have a beneficial effect on the machinability (heat −72). A high amount of copper (about 1.5% in heat −76 and −77) seems to impair machinability in respect of tool wear. A small amount of copper, such as up to about 0.5% (heat −74 and −75), does not seem to have any substantial effect on tool wear.

The machinability for some of the test materials in Example 1 was also tested at the cutting speed 30 m/min. As a function of time, the tool wear were propagating in the same rate or slower for the test materials compared to the lead containing reference material (REF1). FIG. 3 shows the result from the tests with cutting speed 30 m/min. In accordance with the tests with cutting speed 15 m/min a higher amount of sulphur and/or boron give better machinability in respect of tool wear. The positive effect of manganese is reduced compared to the results from the tests with lower cutting speed.

Figure 4:
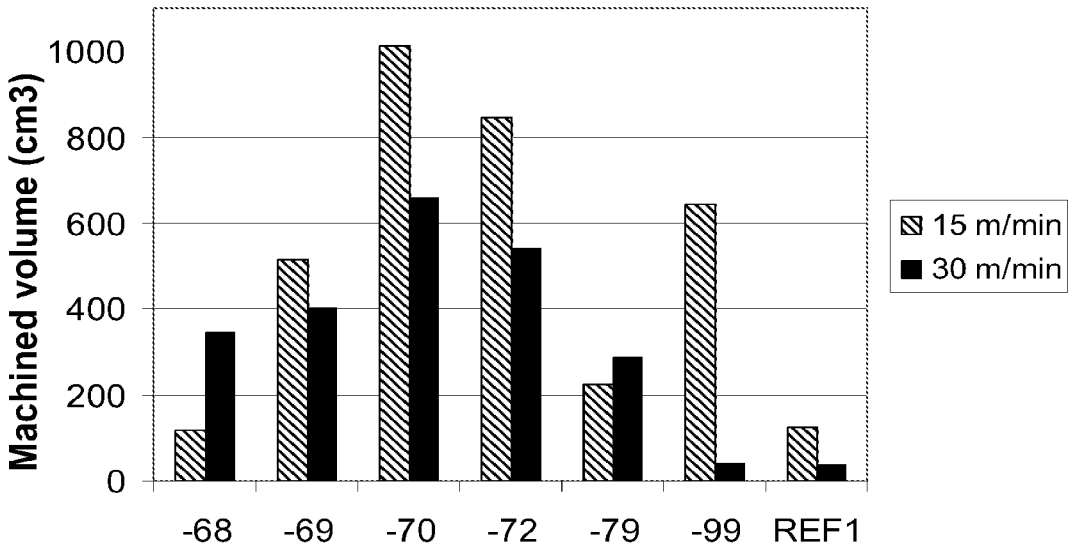
FIG. 4 shows machined volume for some tested compositions when the flank wear on a cutting insert was 0.1 mm, for cutting speeds of 15 m/min and 30 m/min respectively.

FIG. 4 illustrates the machined volume for some of the tested materials at the different cutting speeds (15 m/min and 30 m/min) when flank wear was 0.1 mm. The result for heat −70 is an extrapolation since the test was stopped before the flank wear criterion was reached. In comparison with the lower cutting speed, the higher cutting speed generally gave a higher amount of tool wear as a function of the machined volume. Exceptions were heat −68 and the bismuth alloyed material i.e. heat −79.

Example 5

Wear Resistance

The resistance of the material against sliding wear depends on many material parameters and application parameters. For many applications in the technical field of the test materials it is, however, likely that the two main material parameters that influence wear resistance are the matrix hardness and the amount of hard particles in the material.

With the assumption that the matrix hardness for the hardened material is proportional to the amount of carbon solved in the austenite at the hardening temperature, and that the amount of hard particles in the material is given by the amount of cementite that is not resolved at the hardening temperature, a theoretical comparison between the test materials of Example 1 was made.

Figure 5:
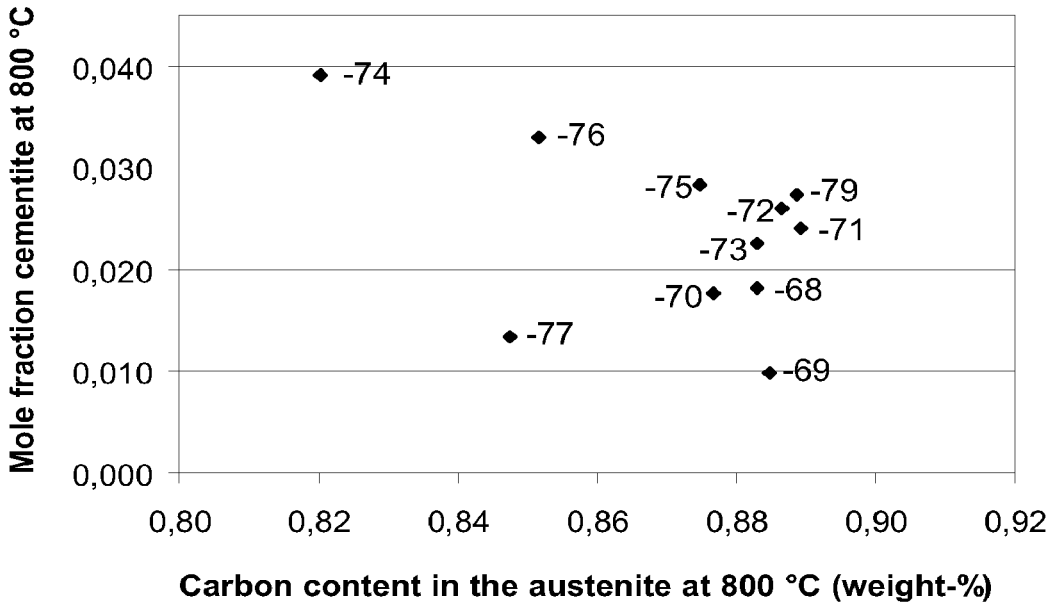
FIG. 5 shows the result of theoretical calculations of the carbon content in the austenite and the mole fraction of cementite remaining at 800° C. for some compositions.

The theoretical calculations were conducted using Thermo-Calc (version Q, data base CCTSS). It should be noted that these calculations assume equilibrium and should therefore only serve as guidance to what might be expected in reality. The result at the temperature 800° C., which is considered to be a suitable temperature for hardening of the alloys according to the invention, is shown in FIG. 5.

The results show that the differences between the test materials are quite small. The high amount of cementite and the lower carbon content at the hardening temperature in heat −74 are probably due to the higher chromium content, which stabilizes the cementite. With a higher hardening temperature more of the cementite in heat −74 can be dissolved giving a higher amount of carbon in the matrix. On the other hand, a higher carbon content in the matrix raises the tendency of residual austenite formation when quenching the material. A high amount of residual austenite lowers the hardness and might also impair the wear resistance of the material.

For heat −77 the lower carbon content gives less carbon solved in the austenite as well as a less amount of cementite remaining at the hardening temperature.

Example 6

Corrosion

The corrosion resistance of the heats according to Example 1, except for heat −99, was tested in a climate chamber. Humidity level has been varied according to a cyclic program in order to simulate real environmental conditions which the steel might be subjected to. The main cycle is built on a repetition of Cycle 1 given below.

Cycle 1

Step 1. Constant condition at 35° C. and 90% relative humidity (RH) for 7 hours.

Step 2. Linear reduction to 45% relative humidity (RH) over a period of 1.5 hours.

Step 3. Constant condition at 35° C. and 45% relative humidity (RH) for 2 hours.

Step 4. Linear increase to 90% relative humidity (RH) for 1.5 hours.

Three test specimens from each material were prepared as Ø40 mm×10 mm. The envelope surfaces of the specimens were turned and the end surfaces were ground. Before start all specimens were immersed during one hour in a sodium chloride solution (1% NaCl) and letting excessive fluid run off for approximately 5 minutes, to accelerate the corrosion rate. For the first cycle, Step 1 was replaced with Step 5.

Step 5. Constant condition at 35° C. and 90% relative humidity (RH) for 6 hours.

The specimens were inspected after 8, 24, 48 and 96 hours of exposure to the cycle given above. At each inspection the amount of corrosion was classified with respect to the corroded area of each specimen. The following designations were used:

A=no corrosion on specimen

B=less than 20% of the surface is corroded

C=between 20% and 70% of the surface is corroded

D=more than 70% of the surface is corroded

The results, given in Table 4 show that the resistance to corrosion, and in particular the time to initiate general corrosion, is reduced when the contents of sulphur and manganese are high so as resulting in formation of manganese sulphides. This can be seen for example in heat −71 and heat −70 which show a corrosion attack according to classification D already after 24 hours. Other elements seem to have no significant impact.

Only minor differences between the alloys exist. Similar to the reference material (REF1), all alloys will corrode with time if the materials are not protected against corrosion. For the intended application, corrosion is not a problem. However, for the handling process, it has to be verified that the material is not left unprotected for a long period of time. Several of the alloys described in the present disclosure display higher corrosion resistance over extended time periods than the reference material.

TABLE 4

| Heat no. | Exposure time/classification 8 hours | 24 hours | 48 hours | 96 hours |
|---|---|---|---|---|
| −68 | B, B, B | C, C, B | C, C, B | C, C, C |
| −69 | C, C, B | C, C, C | C, C, C | C, D, D |
| −70 | C, C, C | D, C, C | D, C, C | D, D, D |
| −71 | C, C, C | D, C, C | D, C, D | D, C, D |
| −72 | C, B, B | C, C, B | D, C, C | D, C, C |
| −73 | C, B, B | C, C, C | C, C, C | C, C, C |
| −74 | C, B, B | C, C, C | C, C, C | C, C, C |
| −75 | C, C, B | C, C, C | C, C, C | C, C, C |
| −76 | C, C, C | C, C, C | C, C, C | C, C, C |
| −77 | B, B, B | C, C, B | C, C, C | C, C, C |
| −79 | B, B, B | C, C, B | C, C, C | C, C, C |
| REF1 | B, B, B | C, C, B | C, C, C | D, D, D |

Example 7

Lame Scale Melts

Three different trial heats of the alloy according to the invention were produced by high-frequency furnace melting with subsequent casting into ingots of 10 tons. To prevent cracking, the material was allowed to slowly cool to 950° C., before reheating to about 1100° C. Thereafter, the material was hot rolled to squared billets 105×105 mm. The billets were ground on all faces before the wire rod rolling were performed. Subsequent wire drawing with soft annealing was performed down to a final size above Ø3 mm followed by straightening and grinding down to Ø3.0 mm. The soft annealing was performed at about 750° C. for approximately 5 hours, followed by controlled cooling at a rate of approximately 10° C./h down to 650° C.

The chemical compositions for the trial heats and for a lead containing reference material (REF2) are given in Table 5, wherein all figures are given in percent by weight. The reference material was produced by means of large scale melting followed by secondary refining and continuous casting.

TABLE 5

| Heat | C | Si | Mn | S | Cr | Ni | Cu | Other |
|---|---|---|---|---|---|---|---|---|
| −307 | 0.86 | 0.38 | 0.58 | 0.081 | 1.53 | 0.05 | 0.37 | |
| −309 | 1.07 | 0.21 | 0.49 | 0.10 | 0.45 | 0.06 | 0.41 | |
| −311 | 1.06 | 0.25 | 0.81 | 0.098 | 0.14 | 0.04 | 0.08 | |
| REF2 | 0.96 | 0.16 | 0.47 | 0.050 | 0.12 | 0.02 | 0.01 | Pb 0.17% |

All compositions of the trial heats contained max 0.03% P, max 0.02% N, max 0.05% Mo, max 0.05% Al and max 0.03% V, which are considered to be impurities in the trial heats.

Figure 6:
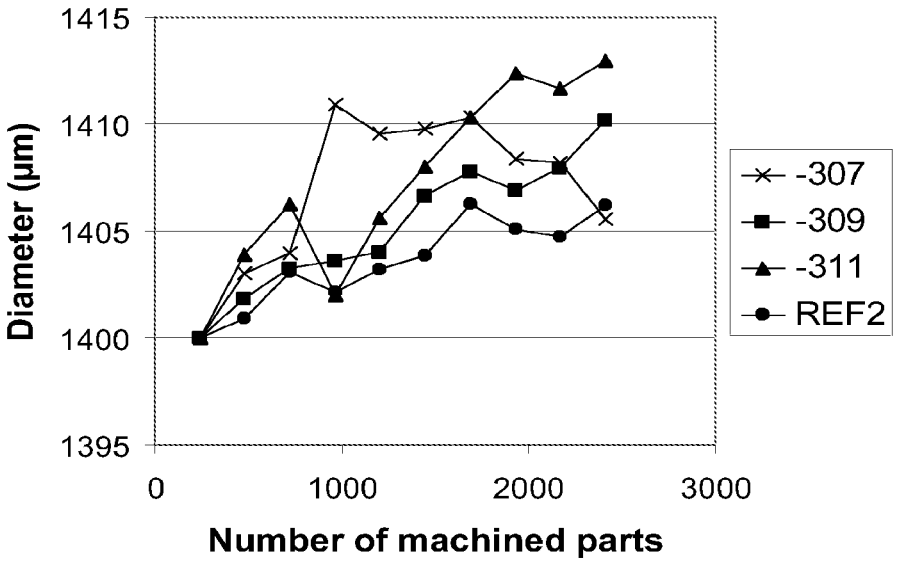
FIG. 6 shows the machinability of some tested compositions as change of diameter as a function of machined parts when using a cutting speed of 20 m/min.
Figure 7:
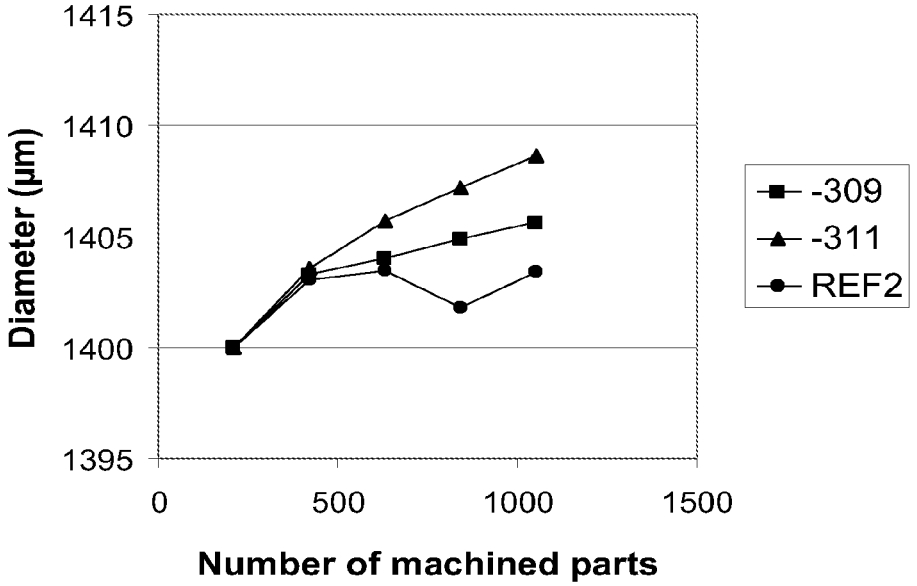
FIG. 7 shows the machinability of some tested compositions as change of diameter as a function of machined parts when using a cutting speed of 30 m/min.
Figure 8:
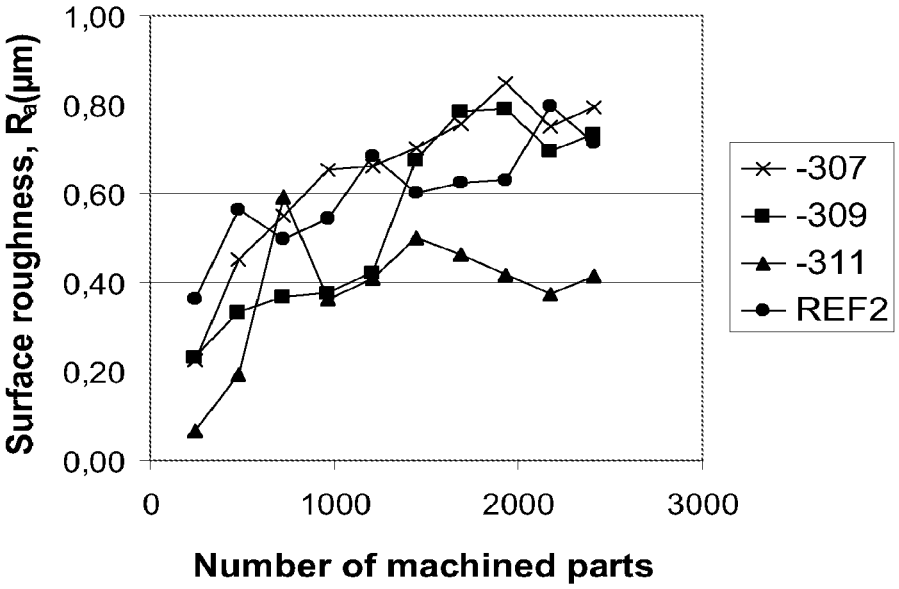
FIG. 8 shows the machinability of some tested compositions as surface roughness as a function of machined parts when using a cutting speed of 20 m/min.
Figure 9:
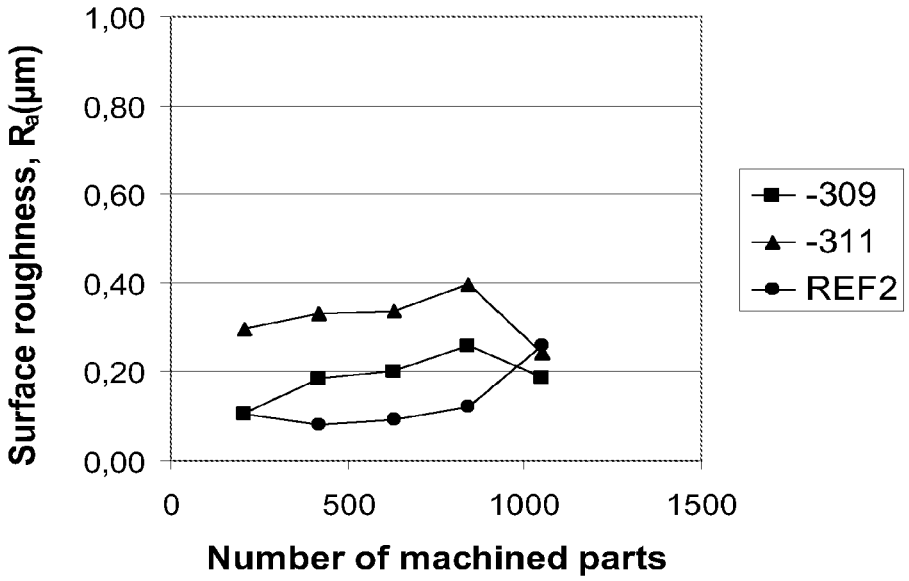
FIG. 9 shows the machinability of some tested compositions as surface roughness as a function of machined parts when using a cutting speed of 30 m/min.

The machinability of all the compositions given in Table 5 was tested. For all machining tests the operation was a plunge cutting operation in which the cutting depth changed between 0.15 mm, 0.80 mm, and 1.0 mm. The cutting speed was 20 m/min or 30 m/min. Cutting feed for all tests was 0,015 mm/revolution. The machining tests were performed with coated indexable hardmetal inserts of the type BIMU 065L 3.5, grade Bi40. Evaluation was done by measuring dimension and surface roughness as a function of cutting time. The results are illustrated in FIG. 6 and FIG. 7, as dimensional change as a function of number of machined parts, and in FIG. 8 and FIG. 9, as surface roughness as a function of number of machined parts.

The results show that all tested compositions except one (heat −307), gives a dimensional change and surface roughness in level with the reference material, REF2. For heat −307 at the cutting speed of 20 m/min the dimensional change displays a different pattern compared to the other heats, see FIG. 6. For the cutting speed of 30 m/min, heat −307 could not be tested due to formation of excessively long chips and difficulties to evacuate the chips.

Higher amounts of sulphur give a better machinability in respect of the dimensional change, probably due to a higher content of manganese sulphides in the material. Chromium seems to have a detrimental effect on the machinability (heat −307).

In addition to the machinability test described above, the test specimens of dimension Ø3 mm were used to investigate the material hardness after hardening followed by tempering. Table 6 shows hardness (HV5) for the materials after hardening at approximately 800° C., during about 4 respectively 10 minutes, and thereafter tempering for 30 minutes at two different temperatures, 250° C., and 400° C.

TABLE 6

| Heat | Hardness [HV5] Soaking time 4 min. After hardening | Tempering at 250° C. | Tempering at 400° C. | Soaking time 10 min. After hardening | Tempering at 250° C. | Tempering at 400° C. |
|---|---|---|---|---|---|---|
| −307 | 715 | 626 | 501 | 746 | 647 | 507 |
| −309 | 852 | 708 | 515 | 857 | 705 | 511 |
| −311 | 847 | 699 | 513 | 864 | 694 | 518 |
| REF2 | 844 | 693 | 503 | 852 | 692 | 496 |

The results show that the differences in hardness after hardening and tempering are small, except for heat −307. The largest difference in hardness between the different heats can be seen prior to tempering, i.e. after hardening, or after tempering at temperatures of 250° C. The difference in hardness for heat −307 compared to the other heats is probably an effect of less dissolved carbides, and a following decrease of carbon content, in the austenite phase during heating, due to a higher chromium content for heat −307.

The invention claimed is:

1. Heat treated lead free steel comprising the following composition in percent by weight (wt-%):

C 0.85-1.2;
Si 0.15-0.30;
Mn 0.4-1.2;
P max 0.05;
S 0.04-0.3;
Cr max 2;
Ni 0.06-0.37;
Mo max 0.5;
Cu 0.3-1.7;
Al max 0.1;
B max 0.008;
Bi+Se+Te max 0.005;
Ti+Nb+Zr+V max 0.2; and
balance Fe and normally occurring impurities,
wherein a phase of the steel consists of martensite.

2. Steel according to claim 1, comprising 0.1-0.5 wt-% Cr.

3. Steel according to claim 2, comprising 0.16-0.18 wt-% Cr.

4. Steel according to claim 1, comprising 0.17-0.52 wt-% Cr.

5. Steel according to claim 1, comprising 0.3-1.0 wt-% Cu.

6. Steel according to claim 1, comprising 0.2-0.3 wt-% Si.

7. Steel according to claim 1, wherein after cooling the steel from 800° C. to 700° C. at a cooling rate of between 33° C. per second and 71° C. per second, the steel has a Vickers hardness (HV1) that is greater than 583 HV1.

8. Steel according to claim 1, wherein the steel has a Vickers hardness (HV1) that is greater than 583 HV1 after a heat treatment, the heat treatment consisting of heating the steel from room temperature to 800° C. at 25° C. per second, holding the steel at 800° C. for 5 minutes, and cooling the steel using a cooling rate that includes a cooling rate of between 33° C. per second and 71° C. per second in a temperature range of from 800° C. to 700° C.

9. Steel according to claim 8, wherein the Vickers hardness (HV1) is greater than 685 HV1 after the heat treatment.

10. Steel according to claim 8, wherein the Vickers hardness (HV1) is between 585 HV1 and 828 HV1 after the heat treatment.

* * * * *